US007445208B2

(12) United States Patent
Onodera

(10) Patent No.: US 7,445,208 B2
(45) Date of Patent: Nov. 4, 2008

(54) SHEET CONVEYING APPARATUS

(75) Inventor: Shinichi Onodera, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 139 days.

(21) Appl. No.: 11/459,149

(22) Filed: Jul. 21, 2006

(65) Prior Publication Data

US 2007/0023995 A1 Feb. 1, 2007

(30) Foreign Application Priority Data

Jul. 28, 2005 (JP) ..... 2005-218848

(51) Int. Cl.
*B65H 9/00* (2006.01)

(52) U.S. Cl. ..... 271/239; 271/226; 271/234; 271/236; 271/238; 271/240; 271/251

(58) Field of Classification Search ..... 271/226, 271/234, 239, 236, 238, 240, 251, 242
See application file for complete search history.

(56) References Cited

U.S. PATENT DOCUMENTS

| | | | | |
|---|---|---|---|---|
| 3,860,233 | A * | 1/1975 | Wiase | 271/239 |
| 3,877,804 | A * | 4/1975 | Hoppner | 399/203 |
| 4,310,236 | A * | 1/1982 | Connin | 399/395 |
| 4,657,239 | A * | 4/1987 | Ikesue et al. | 271/227 |
| 4,936,567 | A | 6/1990 | Fukui | 271/246 |
| 4,971,304 | A * | 11/1990 | Lofthus | 271/227 |
| 5,697,609 | A * | 12/1997 | Williams et al. | 271/228 |
| 6,273,418 | B1 | 8/2001 | Fujikura et al. | 271/228 |
| 6,324,377 | B2 * | 11/2001 | Ando et al. | 399/395 |
| 6,561,504 | B2 * | 5/2003 | Mlejnek et al. | 270/58.12 |
| 6,739,590 | B2 * | 5/2004 | Otsuka | 271/227 |
| 6,910,688 | B2 * | 6/2005 | Saito et al. | 271/220 |
| 2004/0065994 | A1 * | 4/2004 | Halvonik et al. | 271/226 |
| 2004/0212144 | A1 * | 10/2004 | Hozumi | 271/225 |

FOREIGN PATENT DOCUMENTS

| | | |
|---|---|---|
| JP | 63-225052 | 9/1988 |
| JP | 11-189355 | 7/1999 |

* cited by examiner

*Primary Examiner*—Patrick Mackey
*Assistant Examiner*—Prasad V Gokhale
(74) *Attorney, Agent, or Firm*—Fitzpatrick, Cella, Harper & Scinto

(57) ABSTRACT

A sheet conveying apparatus for conveying a sheet to an image forming portion has a first aligning member for effecting the alignment of the sheet with one of the opposite side edges of the sheet parallel to a sheet conveying direction as a reference, a second aligning member for effecting the alignment of the sheet with the leading edge of the sheet orthogonal to the sheet conveying direction as a reference, and an aligning operation controlling device for selectively operating one of the first aligning member and the second aligning member on the basis of at least one of image information, sheet information and sheet processing information.

9 Claims, 17 Drawing Sheets

SHEET CONVEYING APPARATUS

BACKGROUND OF THE INVENTION

1. Field of the Invention

The invention relates to a sheet conveying apparatus, in particular, an apparatus for aligning a sheet.

2. Description of the Related Art

Heretofore, in an image forming apparatus such as a copying machine or a printer, a toner image formed on an image bearing member such as a photosensitive drum in an image forming portion has been transferred to a sheet, and thereafter has been fixed on the sheet by fixing means such as heat fixing means or pressure fixing means to thereby effect image formation.

Such an image forming apparatus is provided with a sheet conveying apparatus for conveying the sheet to the image forming portion. Such a sheet conveying apparatus is provided with a sheet aligning portion for correcting the skew feed or position of the sheet being conveyed, and the skew feed or position of the sheet is corrected by this sheet aligning portion to thereby prevent the deviation of the image formed on the sheet.

As a technique adopted in such a sheet aligning portion, there is one described, for example, in Japanese Patent Application Laid-open No. S63-225052, which corrects the attitude of a sheet by contacting the sheet being conveyed against a stopper provided for forward and backward movement in a sheet conveying path.

Also, there is such a technique as shown in Japanese Patent Application Laid-open No. H11-189355 wherein a sheet is conveyed while a side edge of the sheet contacted against a reference guide along a sheet conveying direction by a diagonal feed roller, whereby the attitude of the sheet is corrected with the side edge of the sheet as the reference.

Now, cut paper is often used in the image forming apparatus and as this cut paper, there is circulated in the market one which is low in the accuracy of the right angle between the leading edge and the side edge orthogonal to each other, or irregular in the degree of the right angle. Further, in other sheets than the cut paper, there is a case where a reduction in or the irregularity of the accuracy of the right angle occurs due to the shrinkage by drying or the like.

Accordingly, when in the conventional sheet conveying apparatus, such a technique as described above which corrects the attitude of the sheet with the leading edge or the side edge of the sheet as the reference, the following problem arises. That is, when use is made of a sheet which is low in the accuracy of the right angle between the leading edge and the side edge, if the attitude of the sheet is corrected, for example, with the side edge thereof as the reference, the deviation of an image forming position will occur relative to the leading edge because the leading edge is not at a right angle with respect to the side edge.

Also, when processing such as bookbinding or cutting is to be effected on a sheet, if the processing such as bookbinding or cutting is effected with the leading edge of the sheet as the reference after sheet alignment is effected, for example, with a side edge of the sheet as the reference, the inclination of an image or the irregularity of an image position will occur because the leading edge is not at a right angle with respect to the side edge.

That is, in a case where the accuracy of the right angle of the sheet is low or in a case where the degree of the right angle of the sheet is irregular, when an image is to be formed on the sheet, deviation occurs to the image forming position, and during the processing of the sheet, the irregularity or the like of an image position occurs.

SUMMARY OF THE INVENTION

So, the present invention has been made in order to solve such problems, and has as its object to provide a sheet conveying apparatus and an image forming apparatus which can reduce the influence of the accuracy of an image forming position and the accuracy or irregularity of the right angle of a sheet during the processing of the sheet.

The present invention provides a sheet conveying apparatus for conveying a sheet to an image forming portion, having: a first aligning unit configured to effect the alignment of the sheet with one of the opposite side edges of the sheet parallel to a sheet conveying direction as the reference; a second aligning unit configured to effect the alignment of the sheet with the leading edge of the sheet orthogonal to the sheet conveying direction as the reference; and aligning operation controlling means capable to selectively operate one of the first aligning unit and the second aligning unit on the basis of at least one of image information, sheet information and sheet processing information.

Also, the present invention provides a sheet conveying apparatus for conveying a sheet to an image forming portion, provided with: a first aligning unit configured to effect the alignment of the sheet with one of the opposite side edges of the sheet parallel to a sheet conveying direction as the reference; a second aligning unit configured to effect the alignment of the sheet with the leading edge of the sheet orthogonal to the sheet conveying direction as the reference; aligning operation controlling means capable to selectively operate one of the first aligning unit and the second aligning unit; and a selection designation input portion for inputting to the aligning operation controlling means designation for selecting one of the first aligning unit and the second aligning unit, wherein the aligning operation controlling means selectively operates one of the first aligning unit and the second aligning unit in accordance with the selection designation inputted from the selection designation input portion.

DESCRIPTION OF THE EMBODIMENTS

The present invention will hereinafter be described in detail with reference to the drawings.

Figure 1:
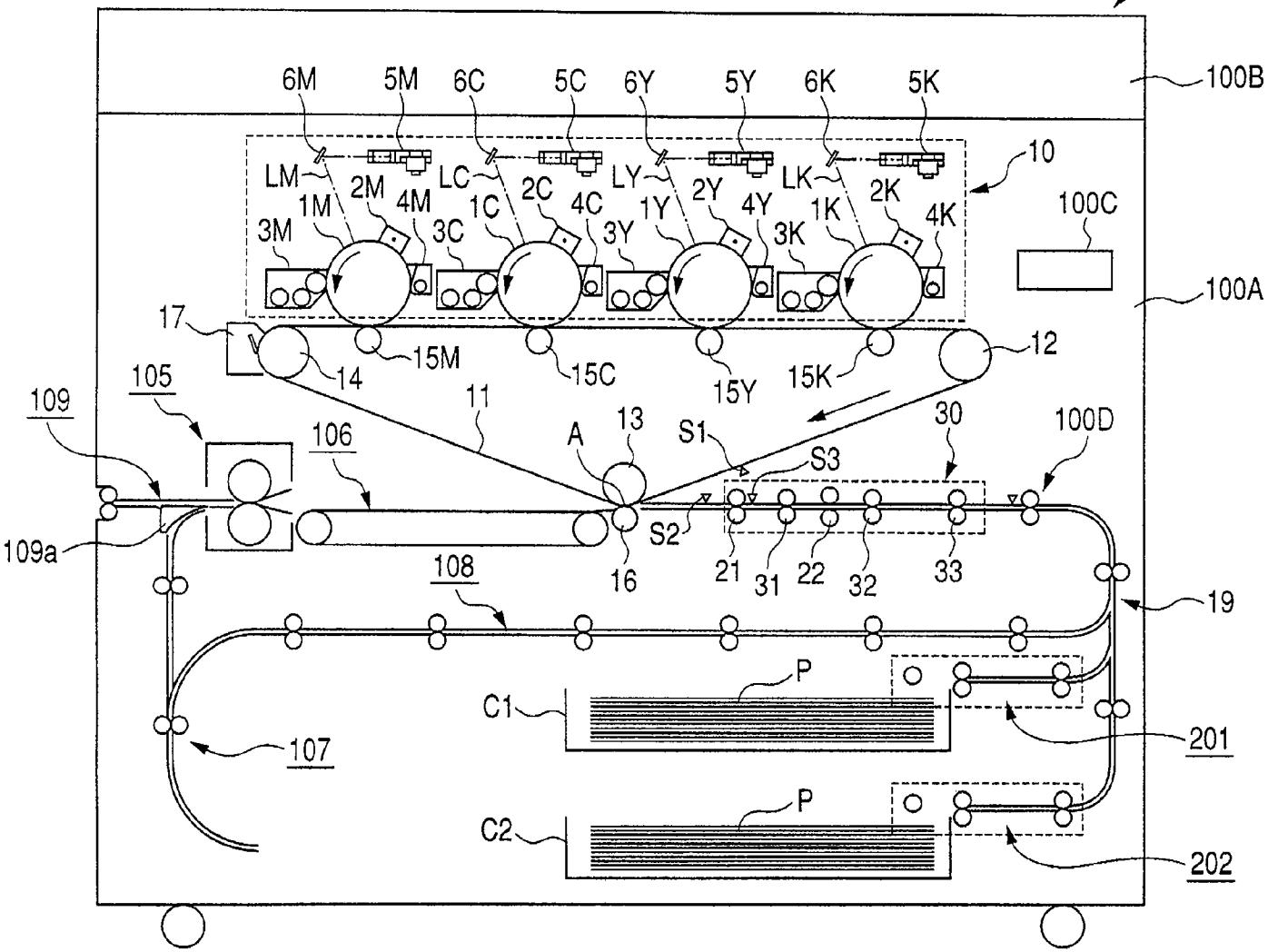
FIG. 1 schematically shows the construction of a digital full-color copying machine, which is an example of an image forming apparatus provided with a sheet conveying apparatus according to a first embodiment of the present invention.

FIG. 1 schematically shows the construction of a digital full-color copying machine having a printer function and a copying machine function which is an example of an image forming apparatus provided with a sheet conveying apparatus according to a first embodiment of the present invention.

In FIG. 1, the reference numeral 100 designates the digital full-color copying machine, the reference character 100A denotes a digital full-color copying machine main body (hereinafter referred to as the copying machine main body), and an image reading device 100B is provided on the upper surface of this copying machine main body 100A. Also, an image forming portion 10 is provided in the upper portion of this copying machine main body 100A, and cassette sheet feeding portions 201 and 202 for feeding sheets P contained in cassettes C1 and C2 are provided in the lower portion thereof.

The sheets P contained in the cassettes C1 and C2 are fed out one by one by the cassette sheet feeding portions 201 and 202, and thereafter are conveyed to a sheet conveying apparatus 100D provided with a sheet feeding and conveying portion 19 and a sheet aligning device 30. The sheet has its skew feed state corrected by a pair of registration rollers 21 provided in the sheet aligning device 30 of this sheet conveying apparatus 100D.

In FIG. 1, an intermediate transfer belt (endless belt) 11 provided downstream of the sheet aligning device 30 is passed over a drive roller 12, a belt support roller 13 and a tension roller 14, and is driven at a constant speed in a direction indicated by the arrow. Also, a pair of secondary transfer rollers 16 constituting a secondary transferring portion A together with the intermediate transfer belt 11 is in contact with this intermediate transfer belt 11. A transfer cleaner 17 is provided at a location opposed to the tension roller 14 and removes any residual toner on the intermediate transfer belt 11.

On the other hand, a plurality of photosensitive drums 1 (1M, 1C, 1Y, 1K) forming and bearing color toner images of different colors thereon which constitute an image forming portion 10 are successively disposed on the upper surface of the horizontal portion of this intermediate transfer belt 11 along the rotation direction of the intermediate transfer belt 11.

Around these photosensitive drums 1 there are installed primary chargers 2 (2M, 2C, 2Y, 2K) for uniformly charging the respective photosensitive drums 1. Also, there are installed developing devices 3 (3M, 3C, 3Y, 3K) for forming the toner images on the photosensitive drums, and cleaners 4 (4M, 4C, 4Y, 4K) for removing residual toners adhering onto the photosensitive drums after the transfer of the toner images.

Description will now be made of the image forming operation of the digital full-color copying machine 100 of such a construction.

First, the image (herein the color image) (not shown) of an original is read by the image reading device 100B, whereafter this read color image is resolved into magenta, cyan, yellow and black color components, and are temporarily stored in an image memory (not shown).

Next, laser beams L (LM, LC, LY, LK) are applied from laser exposing devices 5 (5M, 5C, 5Y, 5K) correspondingly to image information thus stored in the image memory, or image information sent from a controller. Then, these laser beams L are reflected by turn-back mirrors 6 (6M, 6C, 6Y, 6K), and thereafter are applied onto the photosensitive drums 1 rotatably driven in the direction indicated by the arrow. Thereby, electrostatic latent images are formed on the photosensitive drums 1.

Next, the electrostatic latent images formed on the photosensitive drums 1 are developed with magenta, cyan, yellow and black toners supplied from the developing devices 3 (3M, 3C, 3Y, 3K). Thereby, magenta, cyan, yellow and black toner images are formed on the respective photosensitive drums.

Next, the intermediate transfer belt 11 is sequentially passed through primary transferring portions formed by the photosensitive drums 1 and primary transfer rollers 15 (15M, 15C, 15Y, 15K), whereby the magenta, cyan, yellow and black toner images are superposed on the intermediate transfer belt 11.

On the other hand, with such an image forming operation, the sheets P contained in the cassettes C1 and C2 are fed out one by one by the cassette sheet feeding portions 201 and 202, and thereafter are conveyed to the sheet aligning device 30 by the sheet feeding and conveying portion 19. Then, the attitude and position of the sheet are controlled by the pair of registration rollers 21 of this sheet aligning device 30.

After the attitude and position of the sheet have been thus controlled, the pair of registration rollers 21 are driven in timed relationship with the alignment of the toner images superposed on the intermediate transfer belt 11 and the leading edge of the sheet. Thereby, the sheet P having had its attitude and position controlled is conveyed to the secondary transferring portion A constituted by the intermediate transfer belt 11 and the pair of secondary transfer rollers 16. Thereafter, in the secondary transferring portion A, the magenta, cyan, yellow and black toner images superposed on the intermediate transfer belt 11 are collectively transferred to the sheet P thus conveyed to the secondary transferring portion A.

Next, the sheet P passed through the secondary transferring portion A is conveyed to a fixing device 105 by a fixing and conveying portion 106, and is heated and pressurized in this fixing device 105, whereby the transferred toner images are fixed on the surface of the sheet. Thereafter, the sheet P subjected to the fixing process and passed through the fixing device 105 is conveyed to a discharging portion 109, and is further discharged out of the machine.

This digital full-color copying machine 100 can perform the image formation of a two-side mode. When the two-side mode is designated, the sheet P subjected to the fixing process and passed through the fixing device 105 is conveyed toward a reversing portion 107 by a flapper 109*a* provided in the sheet discharging portion 109, and thereafter is reversed by the reversing portion 107 and is conveyed to a two-side conveying portion 108.

Thereafter, the sheet P is further conveyed from the sheet feeding and conveying portion 19 to the sheet aligning device 30 again for image formation by the two-side conveying portion 108. The sheet P subjected to the fixing process and thus conveyed to the sheet aligning device 30 has its skew feed corrected by the pair of registration rollers 21, whereafter images are formed on the two sides of the sheet by the same process as one-side image formation, and the sheet is discharged out of the machine.

The reference character S1 designates an image position detecting sensor provided upstream of the secondary transferring portion A for detecting the positions of the images on the intermediate transfer belt 11, and the reference character S2 denotes a sheet passage detecting sensor provided downstream of the pair of registration rollers 21 for detecting the passage timing of the sheet P. On the basis of the information of the image position detected by the image position detecting sensor S1 and the sheet passage timing detected by the sheet passage detecting sensor S2, a control portion 100C controls the timing at which the pair of registration rollers 21 convey the sheet P to the secondary transferring portion A.

Figure 2:
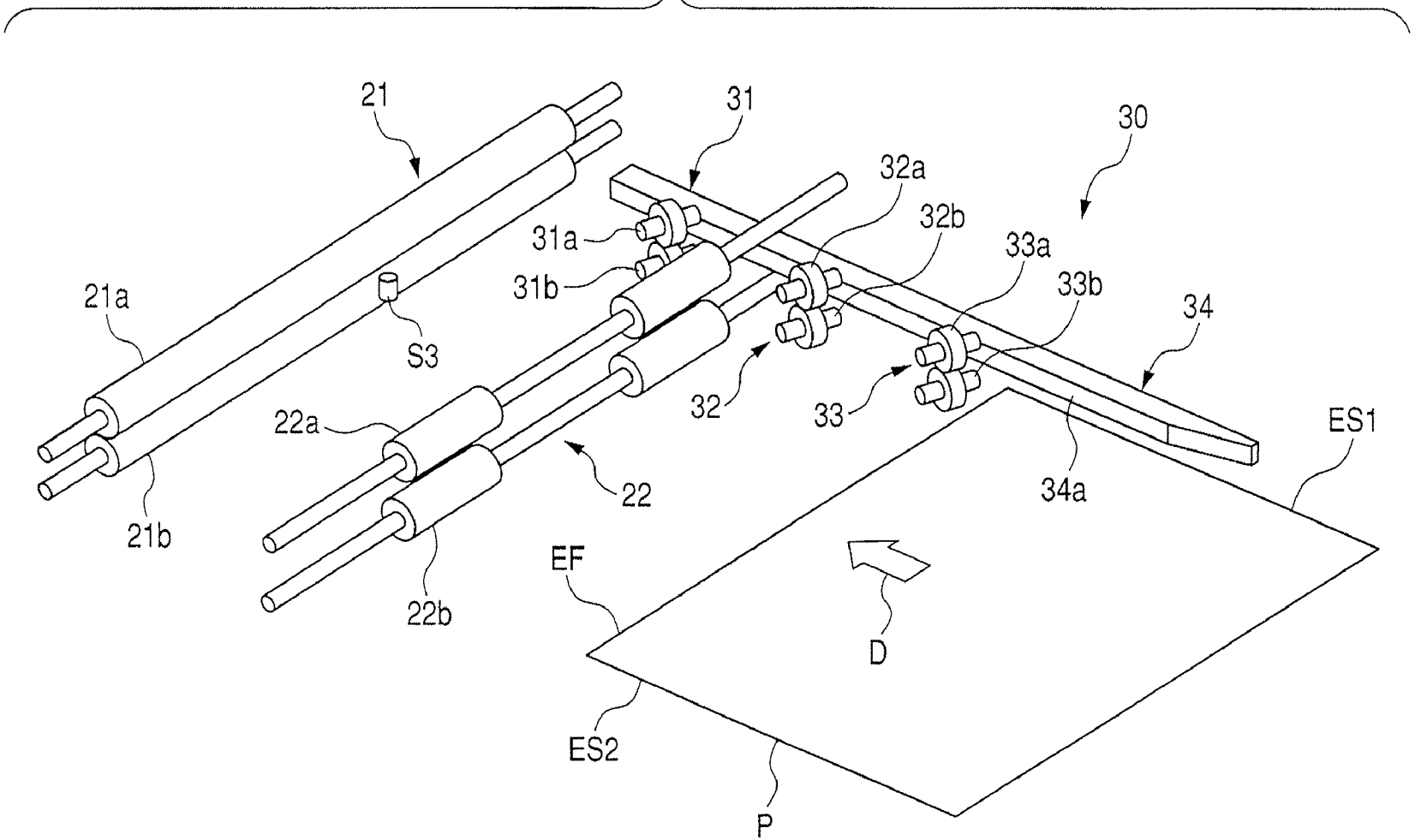
FIG. 2 is a perspective view showing the construction of a sheet aligning device provided in the sheet conveying apparatus.

FIG. 2 is a perspective view showing the construction of the already described sheet aligning device 30 for controlling the attitude and position of the sheet. As shown in FIG. 2, the sheet aligning device 30 is provided with the pair of registration rollers 21 (21*a*, 21*b*) for conveying the sheet P to the secondary transferring portion A, and a pair of ante-registration conveying rollers 22 (22*a*, 22*b*). It is further provided with a side guide 34 which is a reference guide provided along the sheet conveying direction D for guiding one side edge ES1 of the sheet P, and a pair of third diagonal feeding rollers 31 (31*a*, 31*b*) for diagonally feeding the sheet P to the side guide 34. It is further provided with a pair of second diagonal feeding rollers 32 (32*a*, 32*b*), a pair of first diagonal feeding rollers 33 (33*a*, 33*b*) and an ante-registration sheet detecting sensor S3 for detecting the passage of the sheet P on this side of the pair of registration rollers 21.

The pair of ante-registration conveying rollers 22 and the pairs of first to third diagonal feeding rollers 33, 32 and 31 are capable of being spaced apart from each other by a pressure releasing mechanism (not shown). Also, the side guide 34 is movable between a guide position in which it contacts with the side edge ESI of the sheet P to thereby guide the sheet P and a non-guide position in which it is retracted in a direction (hereinafter referred to as the width direction) orthogonal to the sheet conveying direction indicated by the arrow D, by a moving mechanism (not shown).

Now, this sheet aligning device 30 has the side edge aligning function of effecting alignment with one side edge ES1 of the sheet P as the reference, and the leading edge aligning function of effecting alignment with the leading edge EF of the sheet P as the reference. The side edge aligning function and the leading edge aligning function are selectively performed in accordance with a switching signal from an alignment switching control portion 200 shown in FIG. 9 which will be described later.

The sheet aligning operation of such a sheet aligning device 30 will now be described with reference to FIGS. 3 to 8.

The side edge aligning operation will first be described. This side edge aligning operation is performed by a first aligning unit constituted by the side guide 34 and the pairs of first to third diagonal feeding rollers 33, 32 and 31.

Figure 3:
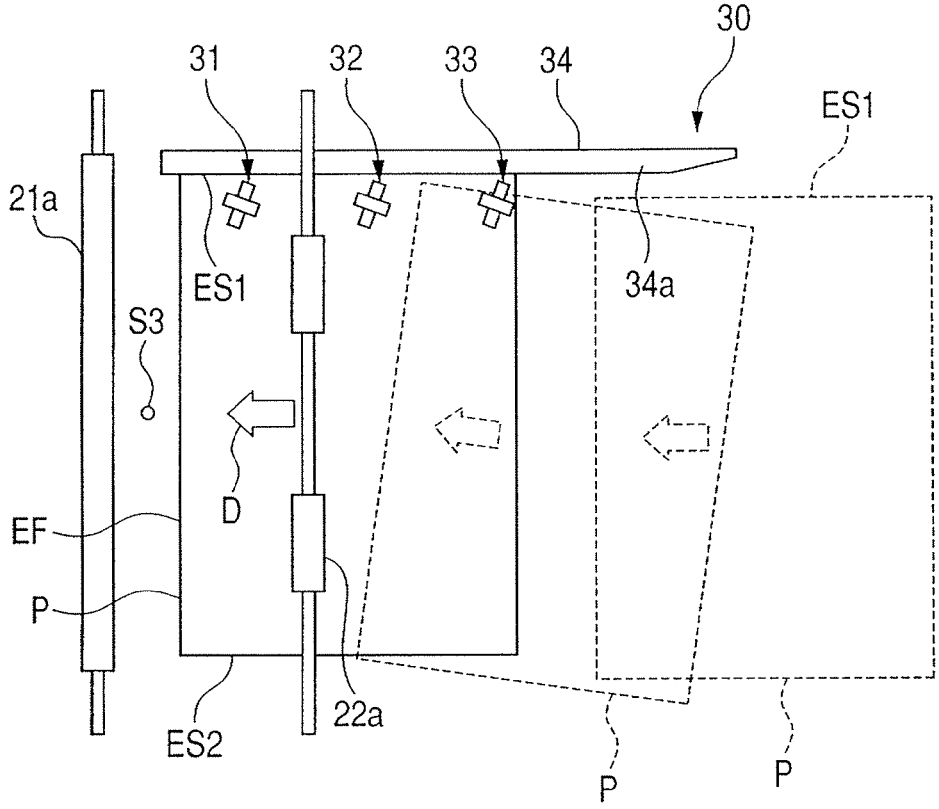
FIG. 3 is a plan view illustrating the side edge aligning operation of the sheet aligning device.

In this case, the side guide 34 is moved to a guide position shown in FIG. 3. When in such a state, the sheet P is conveyed from the sheet feeding and conveying portion 19, the sheet P is sequentially diagonally fed toward the side guide 34 by the pairs of first to third diagonal feeding rollers 33, 32 and 31. Thereby, the sheet P is conveyed along the guide surface 34*a* of the side guide 34 on which the side edge ES1 is at the guide position.

Figure 4:
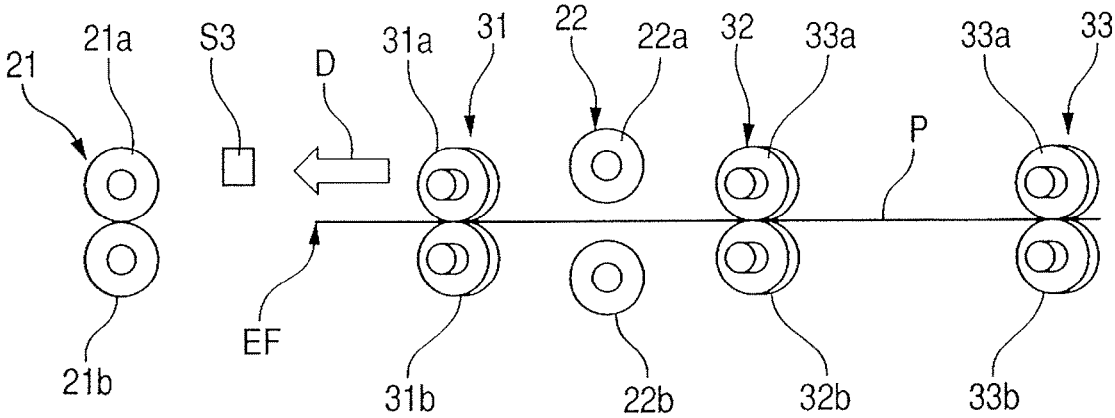
FIG. 4 is a side view illustrating the side edge aligning operation of the sheet aligning device.

At this time, as shown in FIG. 4, the pair of ante-registration conveying rollers 22 are not concerned in the conveyance of the sheet P because an upper roller 22*a* and a lower roller 22*b* constituting the pair of ante-registration conveying rollers 22 are spaced apart from each other.

That is, in a case where the sheet P is aligned by the side edge aligning function with the side edge ESI of the sheet P as the reference, the sheet P is conveyed while being urged against the guide surface 34*a* of the side guide 34 by the pairs of first to third diagonal feeding rollers 33, 32 and 31. Then, the sheet P is delivered to the pair of registration rollers 21 while the side edge ES1 of the sheet P is along the guide surface 34*a* of the side guide 34.

By the side edge ES1 of the sheet P being thus made to be along the guide surface 34*a* of the side guide 34, the alignment of the attitude and side edge position of the sheet with the side edge ES1 of the sheet P as the reference is effected. Further, thereafter the sheet P is delivered to the pair of registration rollers 21, whereafter by the pair of registration rollers 21, the sheet P is conveyed to the secondary transferring portion A in timed relationship with the image on the intermediate transfer belt 11, whereby the alignment of the leading edge of the sheet P and the image can be effected.

The leading edge aligning operation will now be described. This leading edge aligning operation is performed by a second aligning unit constituted by the pair of registration rollers 21 and the pair of ante-registration conveying rollers 22.

Figure 5:
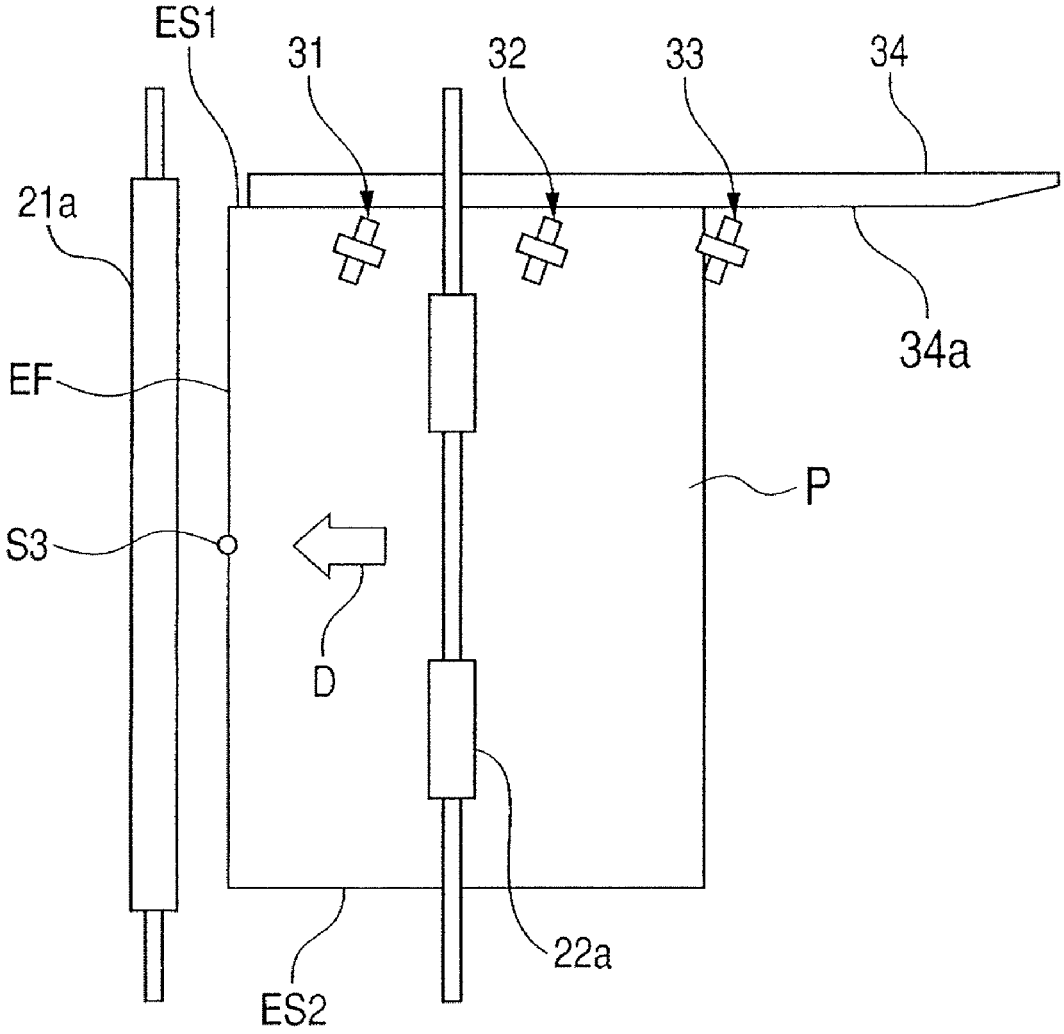
FIG. 5 is a first plan view illustrating the leading edge aligning operation of the sheet aligning device.

In this case, as shown in FIG. 3, the sheet P is conveyed with the side edge ES1 of the sheet P being along the guide surface 34*a* of the side guide 34 by the pairs of first to third diagonal feeding rollers 33, 32 and 31. Thereafter, the leading edge EF of the sheet P arrives at the detecting position of the ante-registration sheet detecting sensor S3, as shown in FIG. 5, whereupon the anti-registration sheet detecting sensor S3 outputs a detection signal, and in accordance with this detection signal, the control portion 100C shown in FIG. 1 sequentially effects the following control.

Figure 6A:
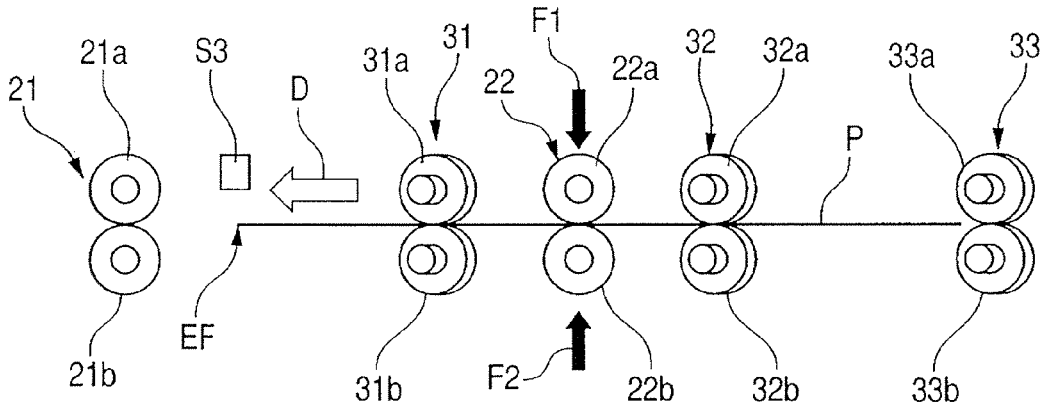
FIGS. 6A and 6B are first side views illustrating the leading edge aligning operation of the sheet aligning device.

First, the upper roller 22*a* and lower roller 22*b* of the pair of ante-registration conveying rollers 22 which are spaced apart from each other are pressed in the directions indicated by the arrows F1 and F2, respectively, as shown in FIG. 6A by a pressure releasing mechanism (not shown) and brought into pressure contact with each other.

Figure 6B:
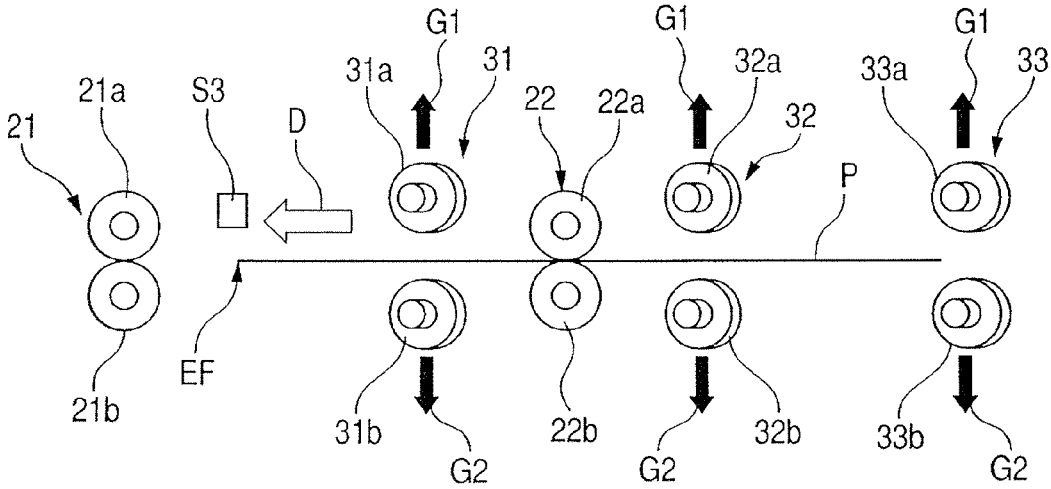

Next, by the pressure releasing mechanism (not shown), the upper rollers 33*a*, 32*a*, 31*a* and lower rollers 33*b*, 32*b*, 31*b* of the pairs of first to third diagonal feeding rollers 33, 32 and 31 are spaced apart from each other in the directions indicated by the arrows G1 and G2, respectively, as shown in FIG. 6B. Further, the side guide 34 is moved and retracted in the direction indicated by the arrow H as shown in FIG. 7 so as to release the contact thereof with the sheet P, and the pair of registration rollers 21 are stopped.

Figure 7:
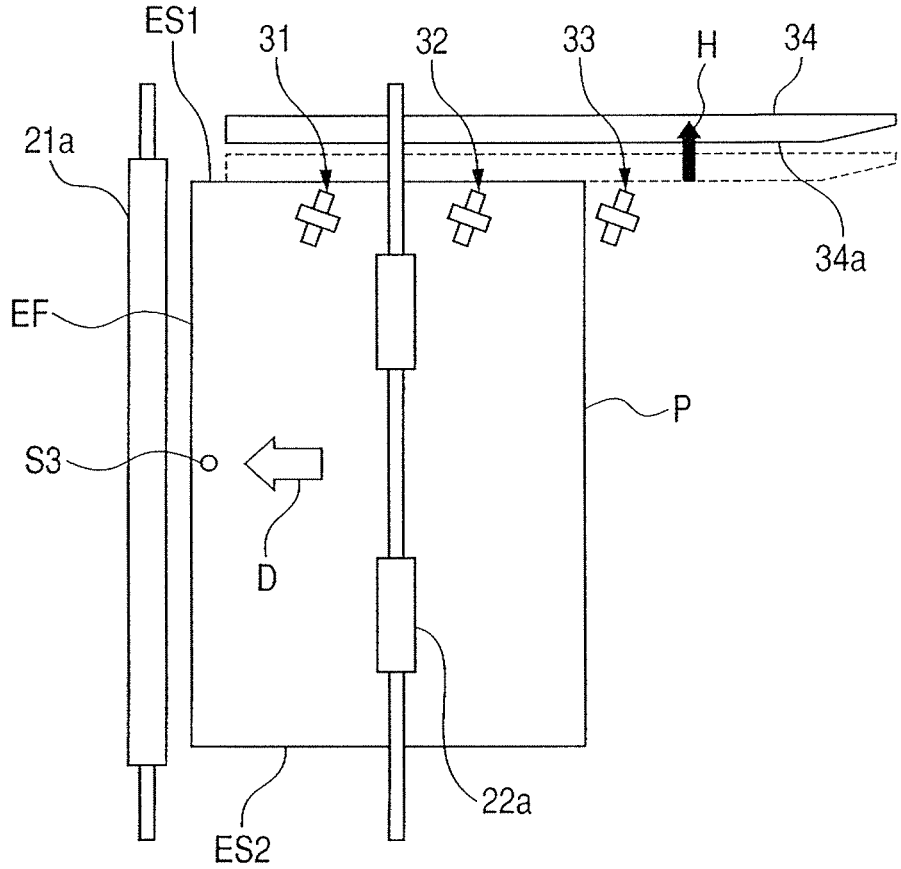
FIG. 7 is a second plan view illustrating the leading edge aligning operation of the sheet aligning device.

By such an operation as shown in FIGS. 6A, 6B and 7, the conveyance of the sheet P is switched from the diagonal feed by the pairs of first to third diagonal feeding rollers 33, 32 and 31 to the rectilinear conveyance by the pair of ante-registration conveying rollers 22, with the side edge ES1 positioned.

Next, the leading edge EF of the sheet P is contacted against the nip portion between the upper roller 21*a* and lower roller 21*b* of the pair of registration rollers 21 as a pair of conveying rollers, by the pair of ante-registration conveying rollers 22 made capable of conveying the sheet P by the pressure contact between the upper roller 22*a* and lower roller 22*b* thereof. At this time, the pair of registration rollers 21 are in a stopped state in accordance with the detection signal of the ante-registration sheet detecting sensor S3.

Figure 8:
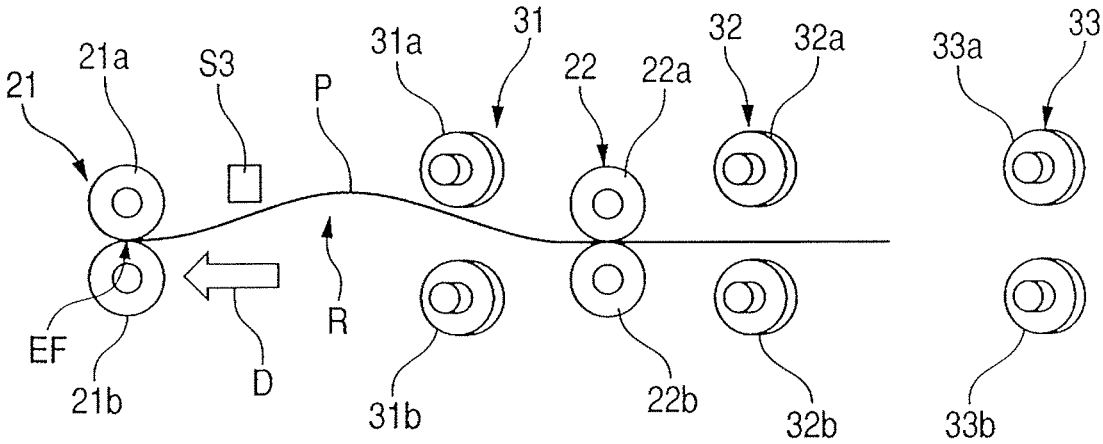
FIG. 8 is a second side view illustrating the leading edge aligning operation of the sheet aligning device.

The pair of ante-registration conveying rollers 22 are driven for a predetermined time with the leading edge EF being thus contacted against the nip portion between the pair of registration rollers 21, whereby as shown in FIG. 8, a loop R is formed between the pair of registration rollers 21 and the pair of ante-registration conveying rollers 22. Thereafter, by the loop R being thus formed, the attitude of the sheet P is corrected so that the leading edge EF may follow the nip portion between the pair of registration rollers 21, whereafter the rotation of the pair of registration rollers 21 is started to thereby convey the sheet P to the secondary transferring portion A.

After the positioning of the side edge ES1 of the sheet P by the side guide 34 has been thus effected, the leading edge EF of the sheet P is contacted against the nip portion between the stopped pair of registration rollers 21, whereby the aligning of the sheet attitude with the leading edge EF of the sheet P as the reference is effected. The alignment of the leading edge EF of the sheet and the image, like the operation by the side edge aligning function, is effected by the sheet P being conveyed to the secondary transferring portion A in timed relationship with the image on the intermediate transfer belt 11 by the pair of registration rollers 21.

Figure 9:
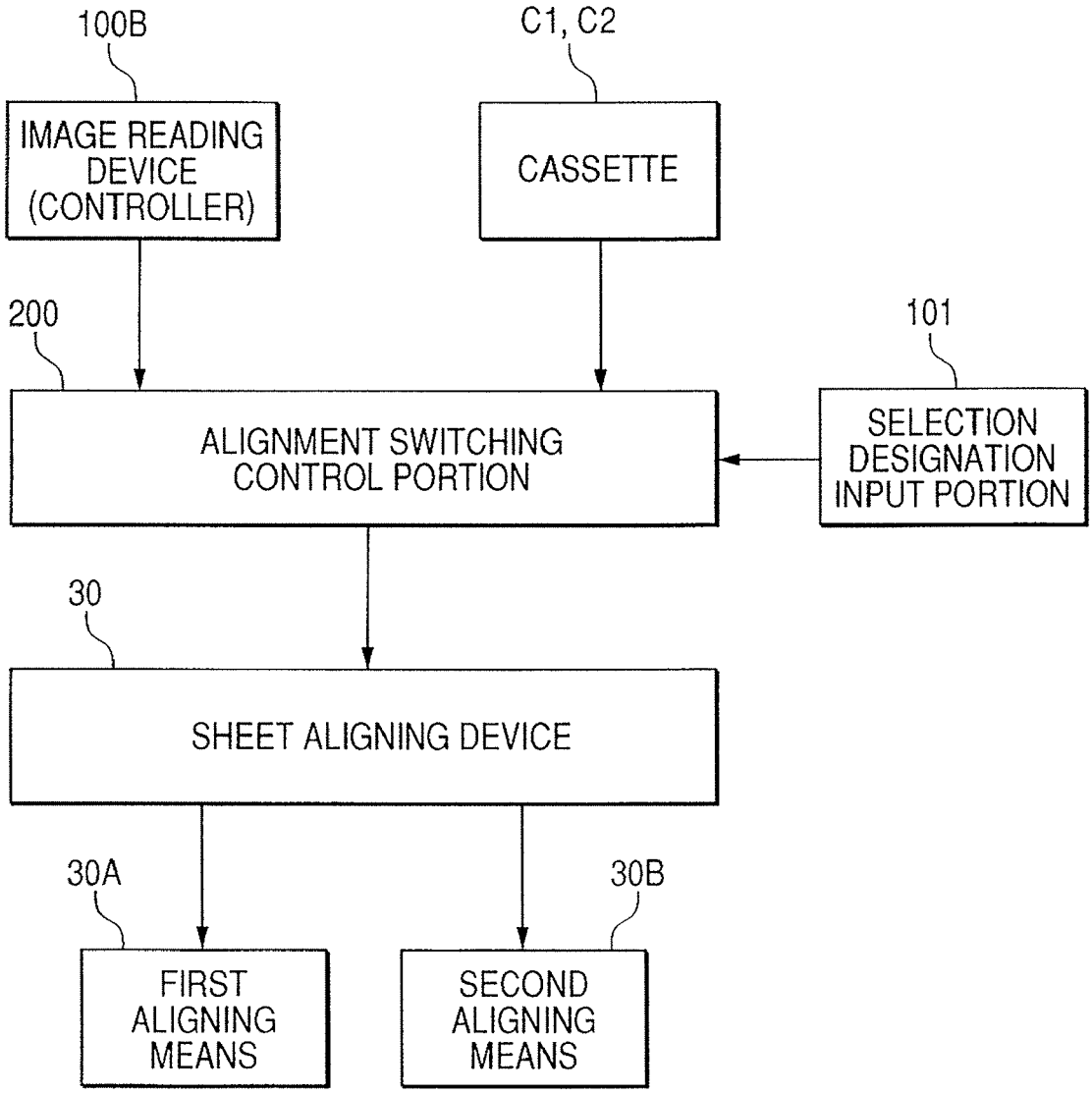
FIG. 9 is a control block diagram of the sheet aligning device.

Now, one of the side edge aligning function and the leading edge aligning function hitherto described is selected and performed in accordance with the switching signal of an alignment switching control portion 200 which is aligning operation controlling means shown in FIG. 9 each time the sheet passes the sheet aligning device 30.

Description will now be made of the switching control of the aligning function by the alignment switching control portion 200.

As shown in FIG. 9, the alignment switching control portion 200 selects one of the side edge aligning function and the leading edge aligning function. This is effected on the basis of image information from the image reading device 100B or the controller, and sheet information such as the sheet size of the sheets P contained in the cassettes C1 and C2 from sheet information detecting means (not shown) provided in the cassettes C1 and C2. The alignment switching control portion 200 transmits a switching signal to the sheet aligning device 30.

Then, this sheet aligning device 30 selectively operates a first aligning unit 30A or a second aligning unit 30B on the basis of the switching signal from the alignment switching control portion 200. The first aligning unit 30A is constituted by the side guide 34 and the pairs of first to third diagonal feeding rollers 33, 32 and 31, and the second aligning unit 30B is constituted by the pair of registration rollers 21 and the pair of ante-registration conveying rollers 22.

The reference numeral 101 designates a selection designation input portion provided at a predetermined location in the copying machine main body 100A, and by this selection designation input portion 101, it is possible to directly input the aligning function selection designation to the alignment switching control portion 200, and the designation of a selecting method for the alignment reference side edge of the sheet based on the image information. Further, it is possible to directly input the designation of the order of priority when the result of the selection of the alignment reference side edge based on the image information and the result of the selection of the alignment reference side edge based on the sheet information differ from each other, and the selection designation of one of the side edge aligning function and the leading edge aligning function.

Here, the selecting method for the alignment reference side edge of the sheet based on the image information can designate so as to select the top and bottom or the left and right of the image transferred to the sheet, on the basis of the image information from the image reading device 100B or the controller.

Figure 10A:
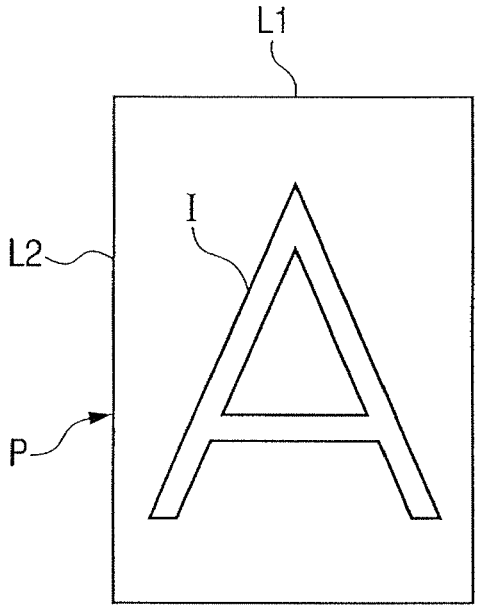
FIGS. 10A and 10B show the orientation of an image, which provides the reference of the aligning operation switching of the sheet aligning device.
Figure 10B:
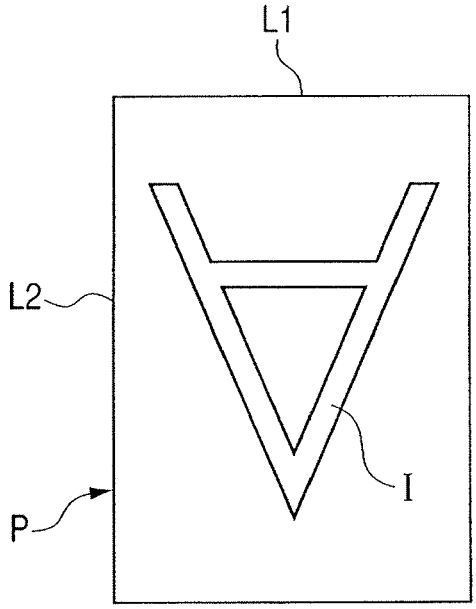
Figure 11A:
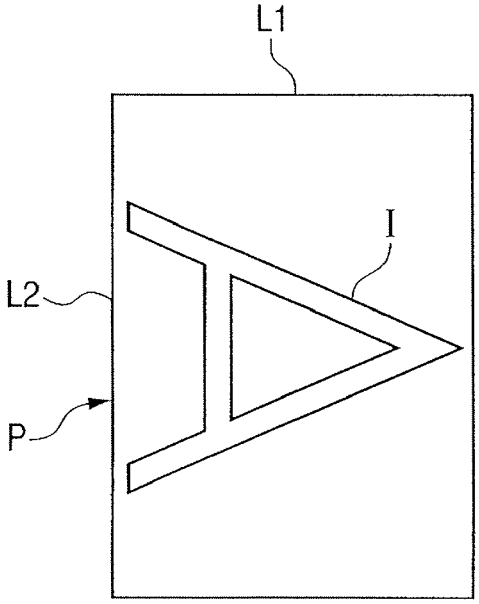
FIG. 11A and FIG. 11B show another example of the orientation of the image which provides the reference of the aligning operation switching of the sheet aligning device.
Figure 11B:
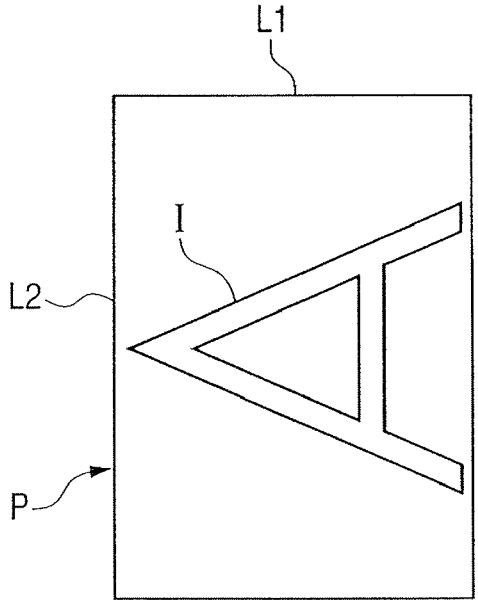

When for example, it designates so as to select the top and bottom of the image as the alignment reference side edge of the sheet on the basis of the image information, if the image I transferred to the sheet P is in such a direction as shown in FIG. 10A or 10B, a side edge L1 which is the side edge of the image in the vertical direction thereof is selected as the alignment reference side edge. Also, if the image I transferred to the sheet P is in such a direction as shown in FIG. 11A or 11B, a side edge L2 which is the side edge of the image in the vertical direction thereof is selected as the alignment reference side edge.

On the other hand, when it designates so as to select the left and right of the image as the alignment reference side edge, the side edge L2 which is the side edge of the image in the horizontal direction thereof with respect to the direction of such an image I as shown in FIGS. 10A and 10B is selected. Also, the side edge L1 which is the side edge of the image in the horizontal direction thereof with respect to the direction of such an image I as shown in FIGS. 11A and 11B is selected as the alignment reference side edge.

Also, the alignment switching control portion 200 is controlled on the basis of the sheet information from sheet information detecting means (not shown) provided in the cassettes C1 and C2. When the longer side of the sheet is particularly long as compared with the shorter side thereof, one of the side edge aligning function and the leading edge aligning function is selected so that the side edge of the longer side may be the alignment reference side edge.

When the result of the selection of the alignment reference side edge based on the image information and the result of the selection of the alignment reference side edge based on the sheet information differ from each other, the order of priority is designated by the selection designation input portion 101. Thereby, only one of the side edge aligning function and the leading edge aligning function can be selected as the alignment reference side edge on the basis of the image information and the sheet information. In the present embodiment, in case of the selection of the alignment reference side edge, priority is given to the selection designation directly inputted by the selection designation input portion 101, relative to the result of the selection of the alignment reference side edge based on the image information and the sheet information.

As described above, the present digital full-color copying machine 100 is provided with the side edge aligning function and the leading edge aligning function, and effects the selection of the alignment reference side edge of the sheet based on the image information in accordance with the selecting method designated by the selection designation input portion 101. Thereby, it is possible to achieve an improvement in the accuracy of the image position according to the use of the outputted sheet.

Also, design is made such that the longer side on which the side edge utilized during alignment is long is selected as the reference during the sheet alignment and therefore, as compared with a case where the shorter side of the sheet is the reference during the sheet alignment, a more stable sheet alignment can be effected without depending on the sheet size and the conveying direction.

Also, the selection designation of one of the side edge aligning function and the leading edge aligning function and the leading edge aligning function is inputted from the selection designation input portion 101, whereby the selection of one of the side edge aligning function and the leading edge aligning function can also be effected without depending on the image forming condition. Therefore, even in a case where processing such as bookbinding or stapling is effected on the sheets after outputted, one of the side edge aligning function and the leading edge aligning function can be selected in accordance with the processing form, whereby the accuracy of the image position after the sheet processing can also be improved.

Usually, in case of sheet processing, a plurality of outputted sheets are bundled, whereafter the aligning process is carried out with a location on the side edge of the sheets as an attitude correction reference and further, with a side edge orthogonal to the side edge which is the attitude correction reference as a positioning reference. Accordingly, during the sheet alignment before this processing, one of the side edge aligning function and the leading edge aligning function can be selected and performed in accordance with the sheet side edge which provides the attitude correction reference or the positioning reference.

Figure 12A:
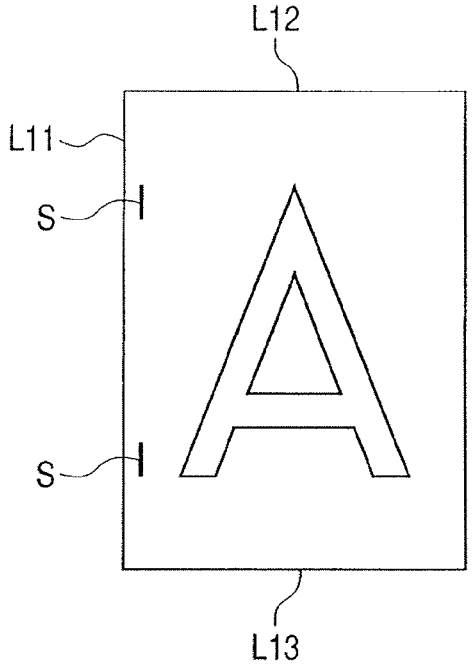
FIG. 12A and FIG. 12B illustrate the alignment reference of a sheet in the stapling process of the sheet aligning device.
Figure 12B:
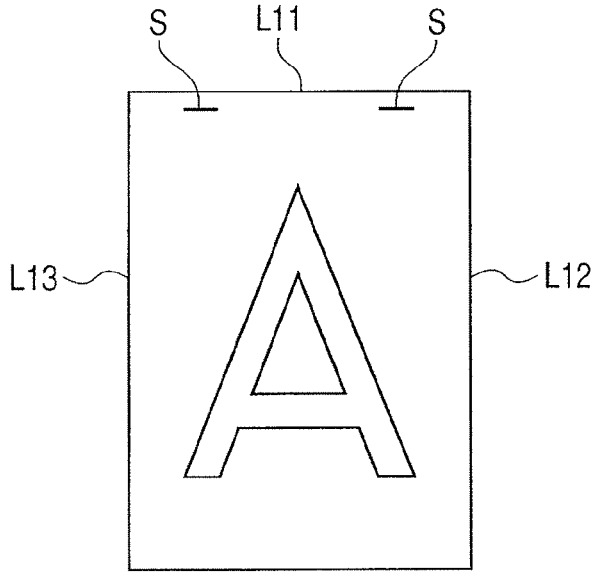

When for example, the stapling process is to be carried out as the processing, usually the sheet alignment before the processing is effected so that the side edge on the side on which stapling is effected may be the attitude correction reference or the positioning reference. Accordingly, when the stapling position is such a stapling position S as shown in FIGS. 12A and 12B, one of the side edge aligning function and the leading edge aligning function can be selected so that a side edge L11 on the stapling position S side may be the reference.

In accordance with the sheet information or the like, one of the side edge aligning function and the leading edge aligning function may be selected so that a location on sheet side edges L12 and L13 orthogonal to the side edge L11 on the stapling position S side may be the reference.

Figure 13:
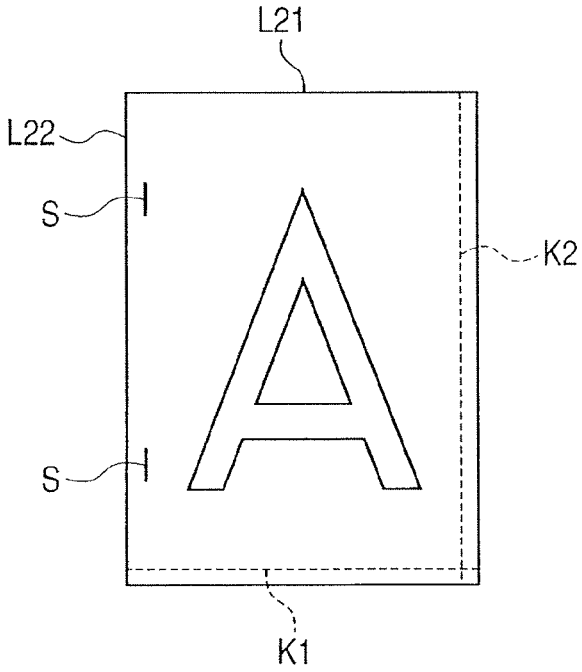
FIG. 13 illustrates the alignment reference of the sheet when the cutting process of the sheet aligning device is carried out.
Figure 14:
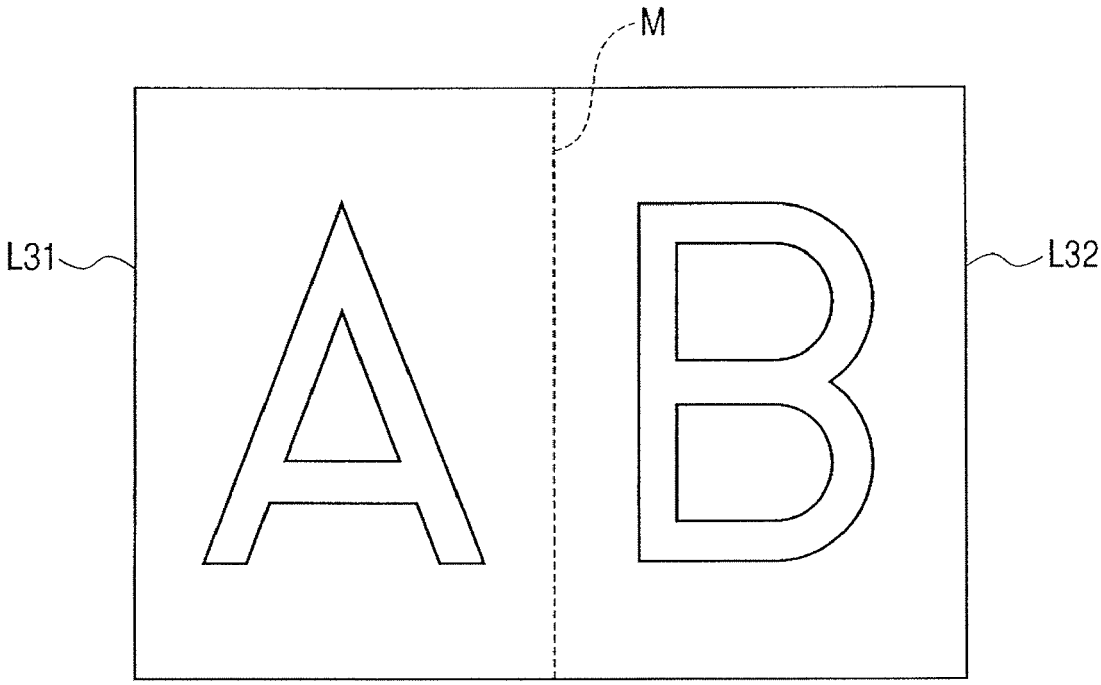
FIG. 14 illustrates the alignment reference of the sheet when the saddle stitching or half-folding of the sheet aligning device is effected.

Also, when the cutting process is to be carried out in bookbinding or the like, as shown in FIG. 13, selection can be effected so that side edges L21 and L22 opposed to cutting positions K1 and K2 which provide the positioning reference during the cutting may be the alignment reference. Also, when saddle stitching or half-folding is to be effected, as shown in FIG. 14, such selection that side edges L31 and L32 parallel to a fold line M are the alignment reference can be effected.

Figure 15:
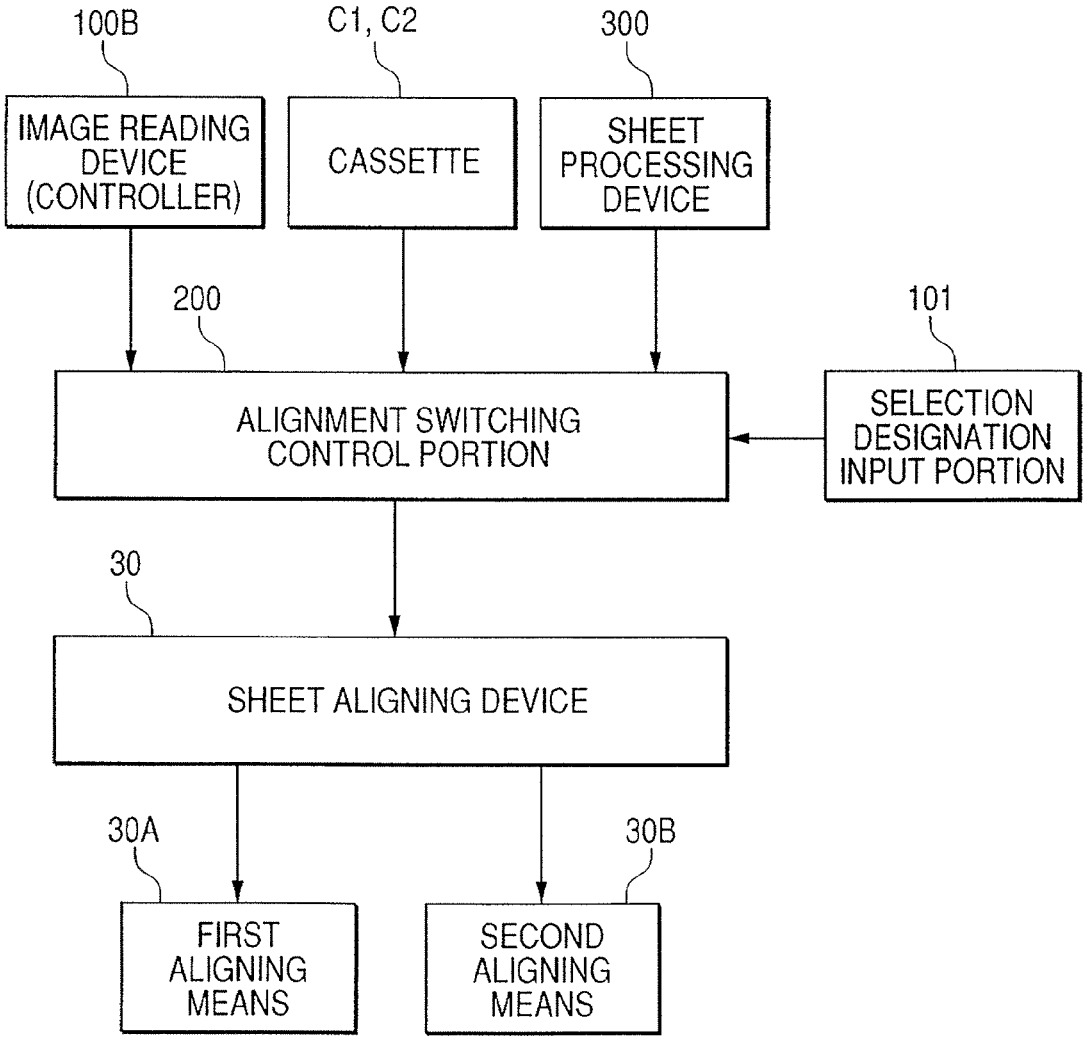
FIG. 15 is a control block diagram of the sheet aligning device when a sheet processing apparatus is provided in the digital full-color copying machine.

Further, the present digital full-color copying machine 100 has connectable thereto a sheet processing apparatus for effecting binding or stapling. When such a sheet processing apparatus is connected and design is made such that processing is effected on in-line on the sheet discharged from the copying machine main body 100A, as shown in FIG. 15, sheet processing information is transmitted from the sheet processing apparatus 300 to the alignment switching control portion 200. Thereby, the alignment switching control portion 200 can selectively operate the first aligning unit 30A or the second aligning unit 30B on the basis of the sheet processing form in addition to the image information and the sheet information.

As described above, on the basis of at least the image information, the sheet information and the sheet processing information, one of the first aligning unit 30A and the second aligning unit 30B is selectively operated to thereby perform one of the side edge aligning function and the leading edge aligning function. Thereby, the influence of the accuracy of the image forming position and the right angle accuracy or irregularity of the sheet during the sheet processing can be reduced.

Figure 16:
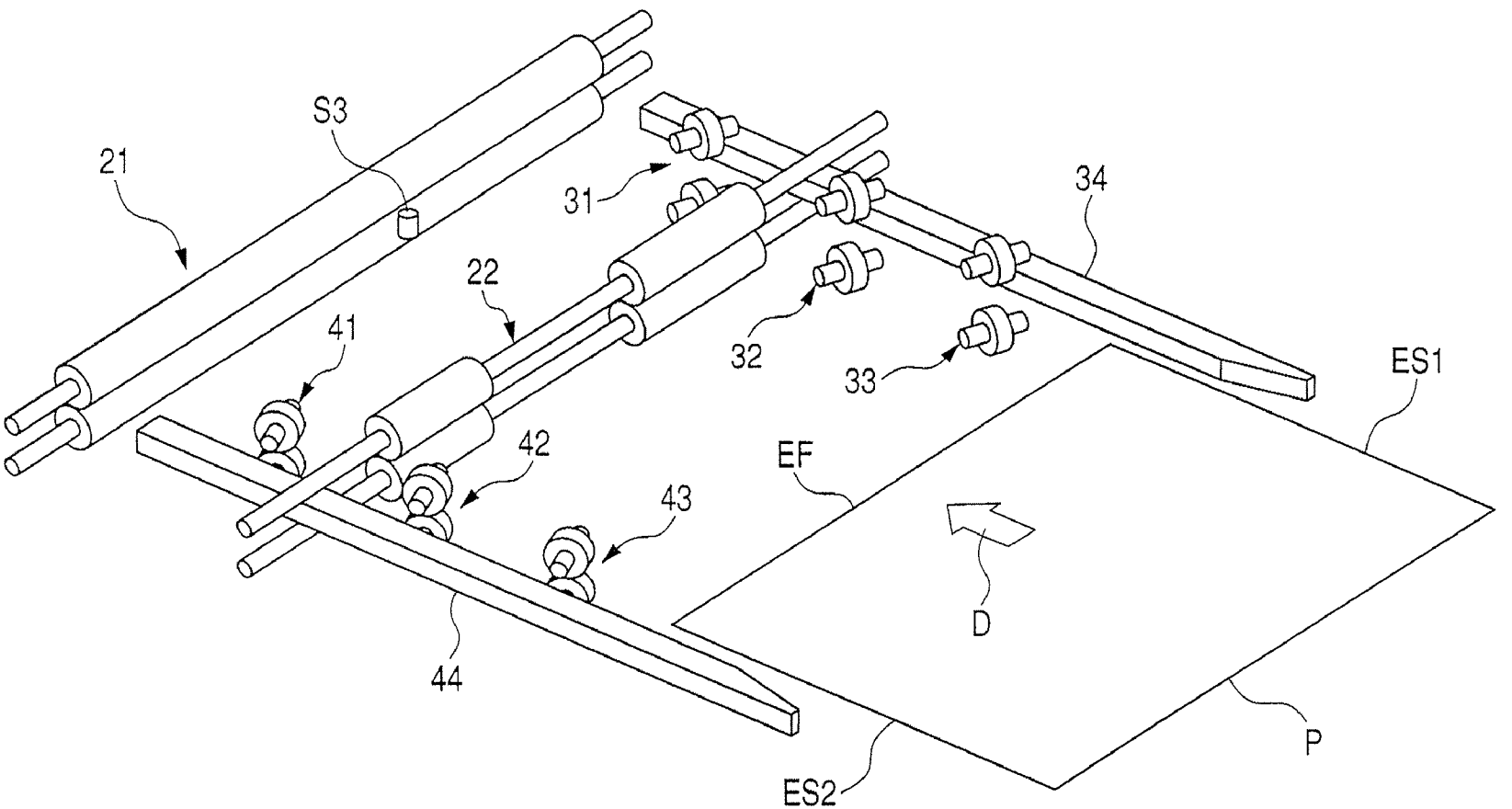
FIG. 16 is a perspective view showing another construction of the sheet aligning device provided in the sheet conveying apparatus.

Now, in the present embodiment, the sheet aligning device 30 has the side edge aligning function with the side edge ESI on one side of the sheet P as the reference, as shown in FIG. 2 already described, but the following may be adopted. As shown in FIG. 16, a side guide 44 which is a reference guide for guiding one side edge ES2 of the sheet is provided in opposed relationship with the side guide 34 for guiding the other side edge ES1 and the pairs of first to third diagonal feeding rollers 33, 32 and 31. Also, pairs of fourth to sixth diagonal feeding rollers 43, 42 and 41 for diagonally feeding the sheet toward this side guide 44 are provided.

The pairs of fourth to sixth diagonal feeding rollers 43, 42 and 41 constituting another first aligning unit and the side guide 44 are provided in opposed relationship with the side guide 34 and the pairs of first to third diagonal feeding rollers 33, 32 and 31. Thereby, in addition to the leading edge EF and one side edge ES1 of the sheet P, the other side edge ES2 of the sheet P can also be utilized as the sheet alignment reference. Thereby, the option of the alignment reference during sheet alignment is increased and further, the accuracy of the image position can be improved.

Figure 17:
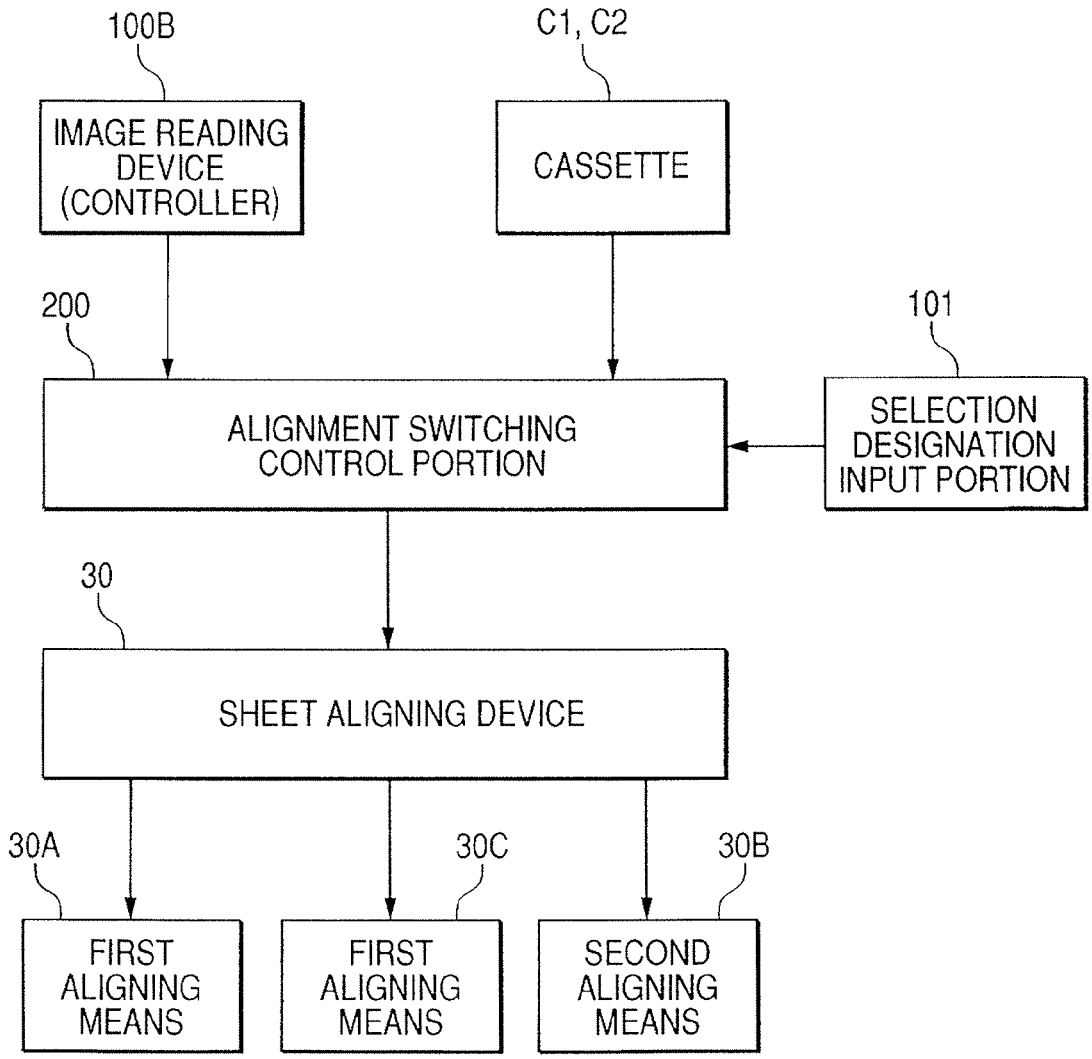
FIG. 17 is a control block diagram of the sheet aligning device.

When as described above, the side edge ES2 of the sheet P is also utilized as the sheet alignment reference, as shown in FIG. 17, the alignment switching control portion 200 can selectively operate another first aligning unit 30C for aligning the side edge ES2, besides the first aligning unit 30A and the second aligning unit 30B.

While in the present embodiment, description has been made of the control based on both of the result of the selection of the alignment reference side edge based on the image information and the result of the selection of the alignment reference side edge based on the sheet information, control may be effected on the basis of the result of the selection of only one of the image information and the sheet information. If for example, on the basis of the sheet information, the longer side on which the side edge of the sheet utilized during alignment is long is selected as the reference during the sheet alignment, stable sheet alignment can be effected.

A second embodiment of the present invention will now be described.

Figure 18:
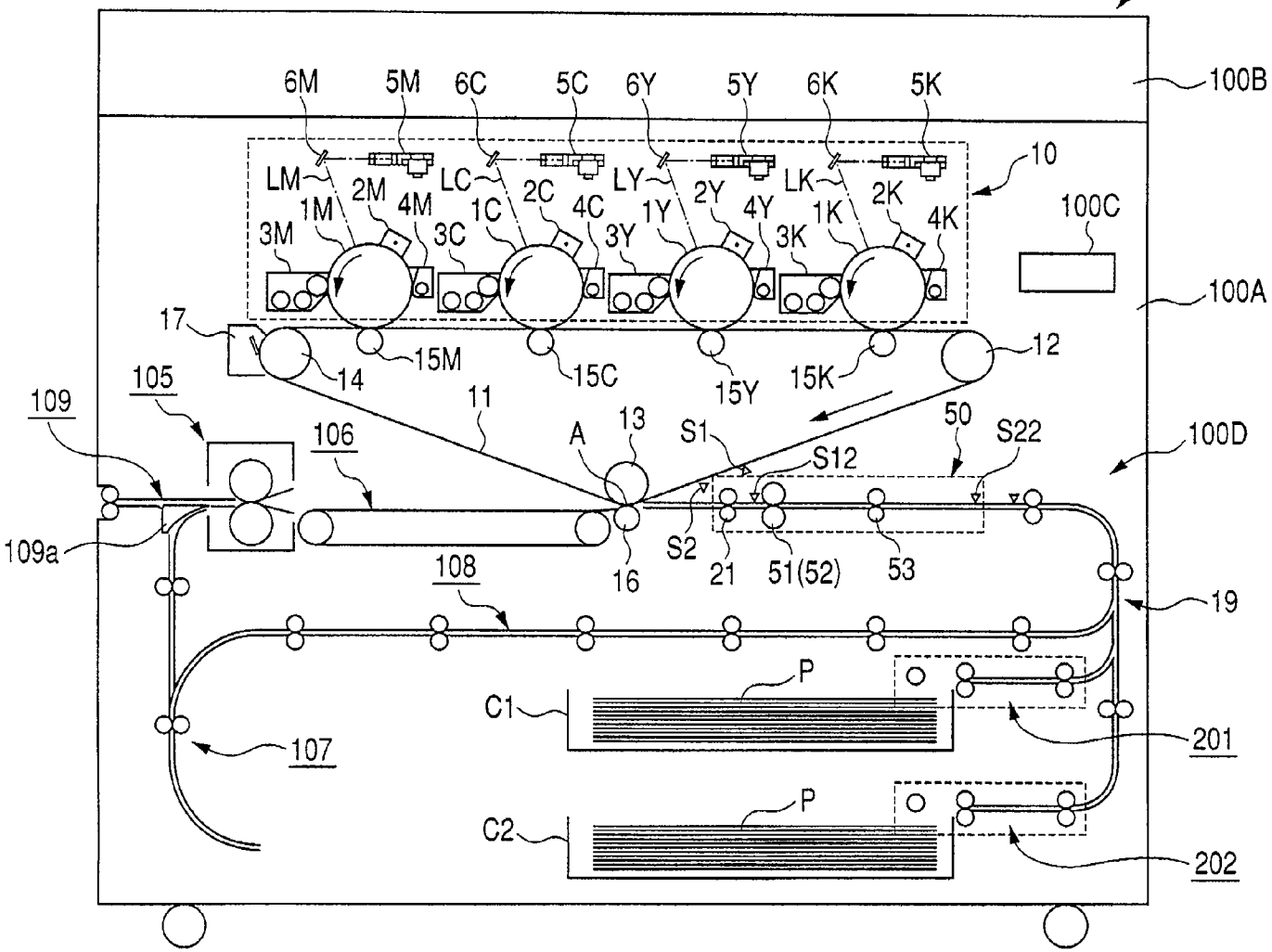
FIG. 18 schematically shows the construction of a digital full-color copying machine, which is an example of an image forming apparatus provided with a sheet conveying apparatus according to a second embodiment of the present invention.

FIG. 18 schematically shows the construction of a digital full-color copying machine which is an example of an image forming apparatus provided with a sheet conveying apparatus according to the present embodiment. In FIG. 18, the same reference characters as those in FIG. 1 designate the same or corresponding portions.

In FIG. 18, the reference numeral 50 denotes a sheet aligning device provided in the sheet conveying apparatus 100D for controlling the attitude and position of a sheet. This sheet aligning device 50 is provided with a pair of attitude controlling rollers 51 and 52, a pair of registration rollers 21 for conveying the sheet P to the secondary transferring portion A in timed relationship with an image on the transfer belt 11, and a pair of relay conveying rollers 53. In the present embodiment, the pair of registration rollers 21 and movable in the width direction by a moving mechanism (not shown).

Figure 19:
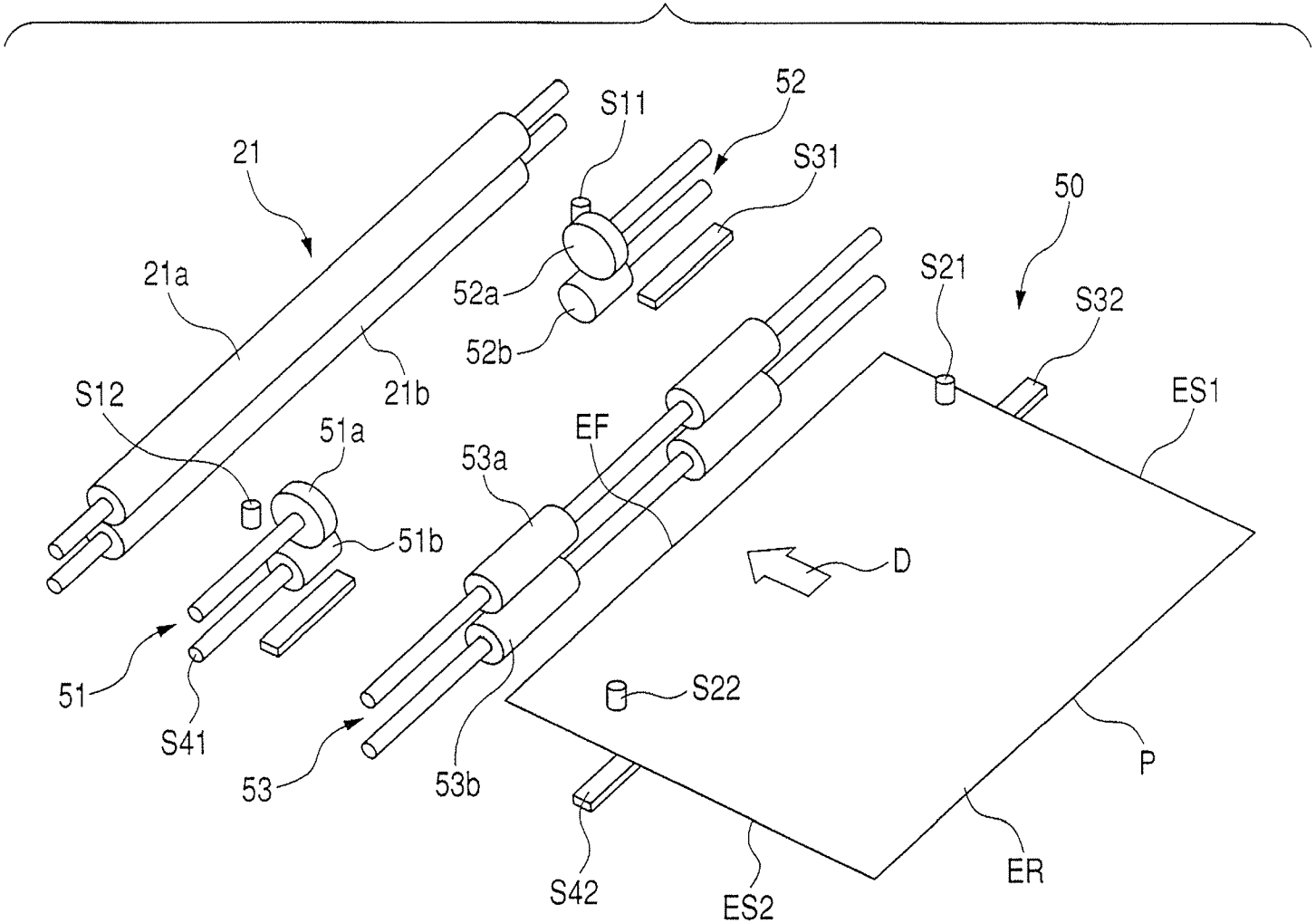
FIG. 19 is a perspective view showing the construction of a sheet aligning device provided in the sheet conveying apparatus.

FIG. 19 shows the construction of such a sheet aligning device 50. The pair of attitude controlling rollers 51 and 52 are provided coaxially with each other in the width direction, and nip and convey the opposite side edge portions of the sheet P and also, are driven independently of each other to thereby change the conveying speed, whereby they can control the attitude of the sheet P.

Figure 20:
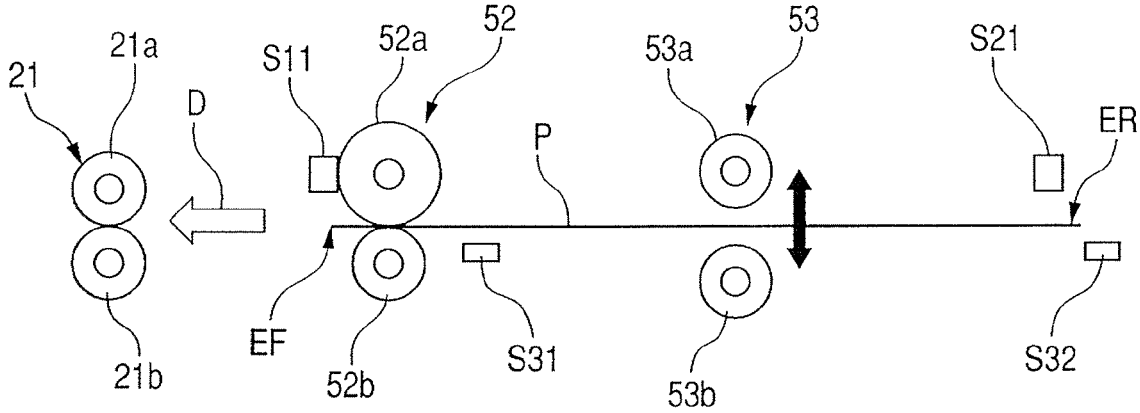
FIG. 20 is a side view showing the sheet attitude controlling operation of the sheet aligning device.

Also, the pair of relay conveying rollers 53 serve to convey the sheet P conveyed from the sheet feeding and conveying portion 19 toward the pair of attitude controlling rollers 51 and 52. Here, an upper roller 53*a* and a lower roller 53*b* constituting the pair of relay conveying rollers 53 are detachably mountable by a pressure releasing mechanism (not shown). After the sheet P is delivered to the pair of attitude controlling rollers 51 and 52 by the pair of relay conveying rollers 53, the leading edge EF of the sheet P is detected by a leading edge detecting sensor S11 disposed downstream of the pair of attitude controlling roller 52 as shown in FIG. 20, whereupon pressure is released and the pair of relay conveying rollers 53 are spaced apart from each other.

The pair of attitude controlling rollers 51 and 52 also have a pressure releasing mechanism (not shown), whereby after the sheet P is delivered to the pair of registration rollers 21, the pressure is quickly released so that the upper rollers 51*a*, 52*a* and the lower rollers 51*b*, 52*b* may be spaced apart from each other.

Now, in the present embodiment, as shown in FIG. 19, the same leading edge detecting sensor S12 as the leading edge detecting sensor S11 is also disposed downstream of another pair of attitude controlling rollers 51 with respect to the sheet conveying direction D at a predetermined interval from the sensor S11 in the width direction.

Figure 21:
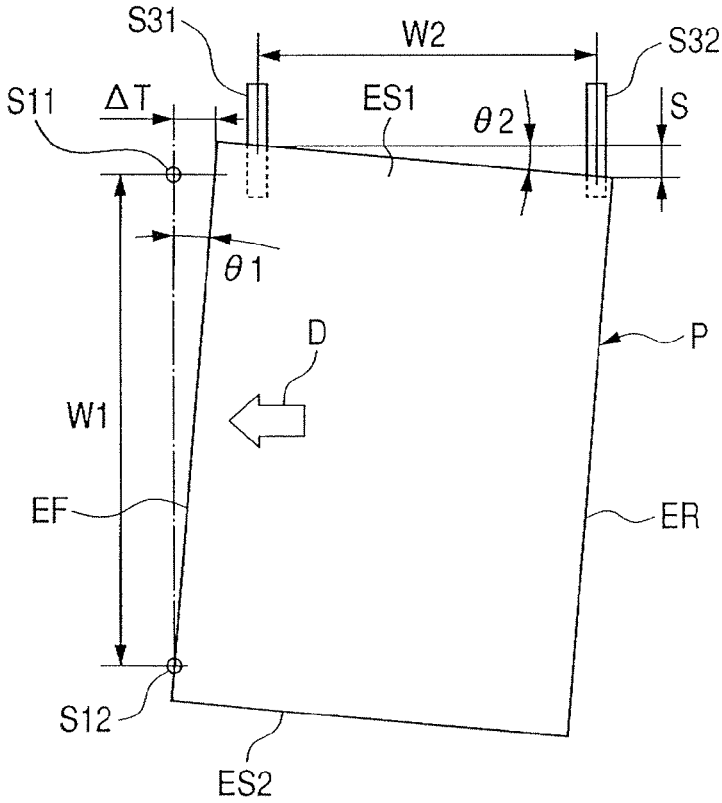
FIG. 21 is a plan view illustrating the sheet attitude controlling operation of the sheet aligning device.

By using the leading edge detecting sensor S12 and the leading edge detecting sensor S11, the deviation $\Delta T$ of the timing at which the leading edge EF of the sheet P passes the two leading edge detecting sensor S11 and S12 shown in FIG. 21 can be found. Further, the inclination $\theta 1$ of the leading edge EF can be found from the distance W1 between the two leading edge detecting sensors S11 and S12.

Further, as shown in FIG. 19, trailing edge detecting sensors S21 and S22 for detecting the passage timing of the trailing edge ER of the sheet P at the opposite side edges are provided upstream of the pair of relay conveying rollers 53. Thereby, the inclination of the trailing edge ER can be found from the deviation of the timing when the trailing edge ER, like the leading edge EF, passes the trailing edge detecting sensors S21 and S22.

On the other hand, at the passage positions of the side edges ES1 and ES2 of the sheet P, there are provided side edge position detecting sensors S31 and S32 and side edge position detecting sensors S41 and S42 for detecting the positions of the side edges ES1 and ES2. Thus, the deviations of two locations on the side edges of the sheet in the width direction can be detected by these side edge position detecting sensors S31, S32, S41 and S42 to thereby find the inclinations of the side edges of the sheet.

When for example, the inclination of the side edge ES1 is to be found, as shown in FIG. 21, the inclination $\theta 2$ of the side edge ES1 of the sheet P can be found from the deviation S of the side edge position in the width direction and the distance W2 between the two side edge position detecting sensors S31 and S32. In this case, the pair of attitude controlling rollers 51 and 52 functioning as the first aligning unit relatively cause a conveying speed difference in accordance with the inclination of the side edge ES1 found in this manner to thereby effect the correction of the attitude of the sheet.

Figure 22:
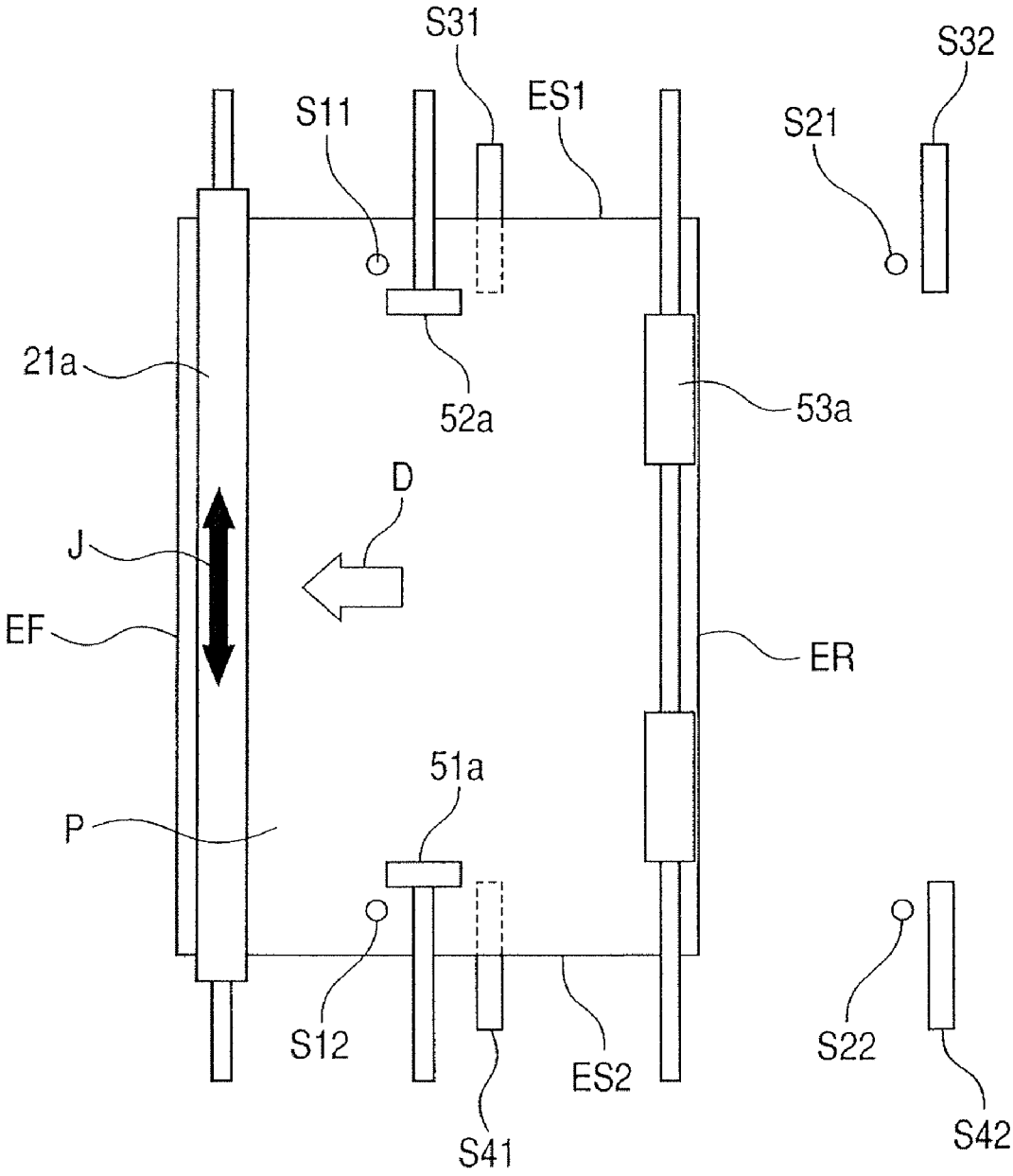
FIG. 22 is a plan view showing the sheet attitude controlling operation of the sheet aligning device.

Further, the pair of registration rollers 21 to which the sheet P has been delivered from the pair of attitude controlling rollers 51 and 52 are moved in the direction indicated by the arrow J by a moving mechanism so that as shown in FIG. 22, the attitude of the side edge ES1 of the sheet P detected by the side edge position detecting sensor S31 may be a predetermined position.

When the leading edge EF or the trailing edge ER of the sheet P is to be aligned, the pair of attitude controlling rollers 51 and 52 which function as the second aligning unit in this case relatively cause a conveying speed difference in accordance with the inclination of the leading edge EF on the trailing edge ER to thereby effect the correction of the attitude of the sheet.

As described above, the pair of attitude controlling rollers 51 and 52 which are attitude correcting means fixed the inclinations of the side edges ES1 and ES2, the leading edge EF and the trailing edge ER of the sheet P by the leading edge detecting sensor S11, S12, the trailing edge detecting sensors S21, S22 and the side edge position detecting sensors S31, S32, S41, S42 which are inclination detecting means. Then, they relatively cause a conveying speed difference in accordance with the inclinations of the side edges ES1, ES2, the leading edge EF and the trailing edge ER of the sheet P to thereby effect the correction of the attitude of the sheet.

The leading edge detecting sensors S11, S12, the trailing edge detecting sensors S21, S22, the side edge position detecting sensors S31, S32, S41, S42 and the pair of attitude controlling rollers 51 and 52 are movable to optimum operative positions in accordance with the sheet size by a moving mechanism (not shown).

The digital full-color copying machine 100 according to the present embodiment, like that according to the already described first embodiment, is also provided with an alignment switching control portion 200, which is adapted to effect the switching of the sheet aligning function on the basis of image forming information such as the image information, the sheet information and the processing form. In the present embodiment, however, the alignment switching control portion 200 selects a sheet side edge which is the reference of the attitude control of the sheet on the basis of the image forming information, and the pair of attitude controlling rollers 51 and 52 effects the attitude control of the sheet with the inclination of the sheet side edge selected by the alignment switching control portion 200 as the reference.

While in the image forming apparatus according to the present embodiment, design is made such that the inclinations of the sheet side edges at four locations are detected, this apparatus has a plurality of detecting means for detecting the inclinations of side edges at least two locations orthogonal to each other. If the alignment switching control portion 200 is designed to select a sheet side edge which becomes the reference of attitude correction on the basis of the image forming information, the influence of the right angle accuracy and irregularity of the sheet side edge can be reduced to thereby improve the accuracy of the image position.

As described above, in the present embodiment, even when any one of a plurality of sheet side edges is selected as the reference, the alignment of the sheet can be effected by the same mechanism and operation and therefore, the simplification of the construction of the sheet aligning portion and an improvement in reliability can be achieved.

The present invention is provided with the first aligning unit for effecting the alignment of the sheet with one of side edges parallel to the sheet conveying direction as the reference, and the second aligning unit for effecting the alignment of the sheet with the leading edge orthogonal to the sheet conveying direction as the reference. One of the first aligning unit and the second aligning unit is selectively operated on the basis of at least one of the image information, the sheet information and the sheet processing information. Thereby, the influence of the accuracy of the image forming position and the right angle accuracy and irregularity of the sheet during sheet processing can be reduced.

While the present invention has been described with reference to exemplary embodiments, it is to be understood that the invention is not limited to the disclosed exemplary embodiments. The scope of the following claims is to be accorded to the broadest interpretation so as to encompass all such modifications and equivalent structures and functions.

This application claims the benefit of Japanese Patent Application No. 2005-218848, filed Jul. 28, 2005, which is hereby incorporated by reference herein in its entirety.

What is claimed is:

1. An image forming apparatus having an image forming portion for forming an image on a sheet conveyed from a sheet conveying apparatus, the image forming apparatus comprising:

a first aligning unit configured to correct an attitude of the sheet with one of opposite side edges of the sheet parallel to a sheet conveying direction;

a second aligning unit configured to correct an attitude of the sheet with a leading edge of the sheet orthogonal to the sheet conveying direction; and aligning operation controlling means capable to selectively operate one of said first aligning unit and said second aligning unit on the basis of at least one of image information, sheet information and sheet processing information, wherein the image forming portion forms the image on the sheet of which the attitude is corrected by the first aligning unit or the second aligning unit.

2. An image forming apparatus according to claim 1, wherein said image information is an orientation of an image to be formed on the sheet in said image forming portion, and said aligning operation controlling means selectively operates one of said first aligning unit and said second aligning unit on the basis of the orientation of the image to be formed.

3. An image forming apparatus according to claim 1, wherein said sheet information is length information of the leading edge and opposite side edges of the sheet, and said aligning operation controlling means selectively operates one of said first aligning unit and said second aligning unit so as to align the sheet with a longest one of the leading edge and opposite side edges of the sheet as a reference.

4. An image forming according to claim 1, wherein said aligning operation controlling means selectively operates one of said first aligning unit and said second aligning unit so as to align a sheet side edge which becomes the reference of an aligning process or a positioning process carried out in case of sheet processing, on the basis of the sheet processing information.

5. An image forming apparatus having an image forming portion for forming an image on a sheet conveyed from a sheet conveying apparatus, the image forming apparatus comprising:

a first aligning unit configured to correct an attitude of the sheet with one of opposite side edges of the sheet parallel to a sheet conveying direction;

a second aligning unit configured to correct an attitude of the sheet with a leading edge of the sheet orthogonal to the sheet conveying direction;

aligning operation controlling means capable to selectively operate one of said first aligning unit and said second aligning unit; and a selection designation input portion configured to input to said aligning operation controlling means designation for selecting one of said first aligning unit and said second aligning unit, wherein said aligning operation controlling means selectively operates one of said first aligning unit and said second aligning unit in accordance with the designation for selection inputted from said selection designation input portion.

6. An image forming apparatus according to claim 5, wherein said first aligning unit diagonally feeds the sheet and conveys the sheet while contacting one of the opposite side edges of the sheet against a guide disposed along the sheet conveying direction to thereby effect alignment.

7. An image forming apparatus according to claim 5, wherein said first aligning unit has two reference guides along the sheet conveying direction provided in opposed relationship with each other in a direction orthogonal to the sheet conveying direction and diagonal feeding means for feeding the sheet diagonally while contacting one of opposite side edges of the sheet against a corresponding one of the reference guides.

8. An image forming apparatus according to claim 5, wherein said second aligning unit contacts the leading edge of the sheet against a nip portion between a pair of conveying rollers being at a stop to thereby effect alignment.

9. An image forming apparatus according to claim 5, wherein said first aligning unit comprises inclination detecting means for detecting an inclination of the side edge of the sheet, and attitude correcting means for correcting an attitude of the sheet with the side edge of said sheet as the reference in accordance with a result of a detection by said inclination detecting means, and said second aligning unit comprises inclination detecting means for detecting an inclination of at least one of the leading edge of the sheet and a trailing edge of the sheet, and attitude correcting means for correcting an attitude of the sheet with the leading edge of said sheet or the trailing edge of said sheet as the reference in accordance with a result of a detection by said inclination detecting means.

* * * * *